US009272544B2

(12) United States Patent
Ohashi

(10) Patent No.: US 9,272,544 B2
(45) Date of Patent: Mar. 1, 2016

(54) CONTROL APPARATUS, CONTROL METHOD, AND STORAGE MEDIUM

(71) Applicant: CANON KABUSHIKI KAISHA, Tokyo (JP)

(72) Inventor: Takakazu Ohashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/692,382

(22) Filed: Apr. 21, 2015

(65) Prior Publication Data

US 2015/0314618 A1 Nov. 5, 2015

(30) Foreign Application Priority Data

May 2, 2014 (JP) ..... 2014-095500

(51) Int. Cl.
*B41J 29/38* (2006.01)
*B41J 11/66* (2006.01)

(52) U.S. Cl.
CPC ..... *B41J 11/663* (2013.01)

(58) Field of Classification Search
USPC ..... 347/4–6, 9, 12–14, 16, 17, 19, 20–23, 347/25, 30, 40–44, 47, 68, 84–86, 96–98, 347/104, 105, 197, 198
See application file for complete search history.

(56) References Cited

U.S. PATENT DOCUMENTS 8,174,726 B2 * 5/2012 Shingai ..... H04N 1/3873 347/14
2006/0227158 A1 * 10/2006 Otani ..... G06F 3/1208 347/14
2011/0261130 A1 * 10/2011 Hirai ..... B41J 29/17 347/104
2012/0194599 A1 * 8/2012 Kido ..... B41J 11/0065 347/19

FOREIGN PATENT DOCUMENTS

JP 2004-181843 A 7/2004

* cited by examiner

*Primary Examiner* — Kristal Feggins
(74) *Attorney, Agent, or Firm* — Fitzpatrick, Cella, Harper & Scinto

(57) ABSTRACT

An embodiment of this invention is directed to reducing waste paper caused by a margin added between images even between different jobs. According to the embodiment, a printing unit is caused to print an image based on an input job. It is determined, in accordance with a mode of a first job and a mode of a second job next to the first job, whether to provide a margin between an image printed based on the first job and an image to be printed based on the second job.

10 Claims, 11 Drawing Sheets

CONTROL APPARATUS, CONTROL METHOD, AND STORAGE MEDIUM

BACKGROUND OF THE INVENTION

1. Field of the Invention

The present invention relates to a control apparatus, a control method, and a storage medium, and particularly to, for example, a control apparatus and a control method for conveying a print medium such as rolled printing paper, performing marginless print using an inkjet printhead, and cutting and discharges the paper.

2. Description of the Related Art

A printing apparatus incorporated in a printer, copying machine, facsimile apparatus, or the like is configured to supply a print medium from a feeding unit and print an image on the print medium by a printhead based on image data. In general, a print medium such as roll paper, a cut sheet, or a plastic sheet is used. In particular, many printing apparatuses that handle a large print medium use a so-called rolled print medium, and generally include a cutting mechanism that cuts printed roll paper at a predetermined position.

A printing apparatus including a cutting mechanism conventionally uses two types of marginless print, that is, marginless one-cut print and marginless two-cut print to produce a print product without a margin on the four sides. In the marginless one-cut print, images to be continuously printed in the conveyance direction of roll paper are printed without adding a margin between them, and the boundary between the printed images is cut by the cutting mechanism, thereby implementing marginless print. In the marginless two-cut print, a margin is added between images to be continuously printed in the conveyance direction of roll paper. On each of the leading end side and the tail end side of each image in the conveyance direction of roll paper, the cutting mechanism cuts the boundary between the image and the margin at a portion close to the image, thereby implementing marginless print.

In the marginless one-cut print, since no margin is added between images, waste paper can be reduced. On the other hand, in the marginless two-cut print, a margin is added between images to absorb a cutting position shift caused by the position shift of the cutting mechanism or an error due to conveyance accuracy limit and an error due to the cutting accuracy of the cutting mechanism in the roll paper width direction. This can prevent adjacent images from stepping in and maintain the quality of the print product. Hence, the user selectively uses marginless one-cut print or marginless two-cut print in accordance with the application purpose of a printed image or print product.

As a printing apparatus having a marginless print function of this type, a printing apparatus disclosed in Japanese Patent Laid-Open No. 2004-181843 is known. In Japanese Patent Laid-Open No. 2004-181843, upon receiving a marginless print job, it is determined whether the received job prints a plurality of images. If the received job prints a plurality of images, and the boundaries between the images to be continuously printed are similar, marginless one-cut print is used. If the boundaries between the images to be continuously printed are not similar, or the received job prints one image, marginless two-cut print is used.

Note that marginless one-cut print needs to continuously print a plurality of images in the conveyance direction of roll paper without adding a margin between them. If the received job prints one image, images are not continuously printed. Hence, the image is printed by marginless two-cut print. The image printing state of marginless print in the conventional printing apparatus will be described here with reference to a drawing.

FIG. 11 is a view showing a state in which images are printed by specifying marginless one-cut print in different jobs by the conventional printing apparatus. FIG. 11 illustrates a state in a case where different job A, job B, and job C of marginless one-cut print are continuously received, and the images are printed on roll paper 1.

Note that the job A, job B, and job C print two images, one image, and one image, respectively. As shown in FIG. 11, the conventional printing apparatus prints a first image A101 of the job A and a second image A102 of the job A without adding a margin between them. On the other hand, a margin is added between the second image A102 of the job A and an image B101 of the job B and between the image B101 of the job B and an image C101 of the job C. That is, a leading end fed portion 30 as waste paper is formed between the jobs, that is, between the second image of the job A and the image of the job B and between the image of the job B and the image of the job C.

As described above, in Japanese Patent Laid-Open No. 2004-181843, when a marginless print job is received, it is determined whether the received job prints a plurality of images, and the mode is switched between the marginless one-cut print and the marginless two-cut print in accordance with the determination result. That is, the mode is switched between the marginless one-cut print and the marginless two-cut print in accordance with the number of images and the print images in the same job.

However, upon printing a plurality of images in one job using marginless one-cut print, efficient paper use is possible. However, upon printing one image, waste paper is created because of switching to marginless two-cut print. In addition, continuous image print by marginless one-cut print is possible only in the same job. For this reason, if images of different jobs are continuously printed by marginless one-cut print, margins are added between the continuously printed images. Hence, the margin portions are formed as waste paper.

SUMMARY OF THE INVENTION

Accordingly, the present invention is conceived as a response to the above-described disadvantages of the conventional art.

For example, a control apparatus, a control method, and a storage medium according to this invention are capable of reducing a waste print medium created by a margin added between images.

According to one aspect of the present invention, there is provided a control apparatus comprising: a print control unit configured to cause a printing unit to print an image on a print medium based on a job; and a determination unit configured to determine, in accordance with a mode of a first job and a mode of a second job next to the first job, whether to add a margin between an image to be printed based on the first job and an image to be printed based on the second job.

According to another aspect of the present invention, there is provided a control method comprising: causing a printing unit to print an image based on an input job; and determining, in accordance with a mode of a first job and a mode of a second job next to the first job, whether to provide a margin between an image printed based on the first job and an image to be printed based on the second job.

According to another aspect of the present invention, there is provided a non-transitory computer readable storage medium which stores a computer program to be executed in a control apparatus, the program implementing the above control method.

The invention is particularly advantageous since continuous print without adding a margin is performed even between different jobs, and the boundaries between continuously printed images are cut, occurrence of a waste print medium can be reduced.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Figure 1:
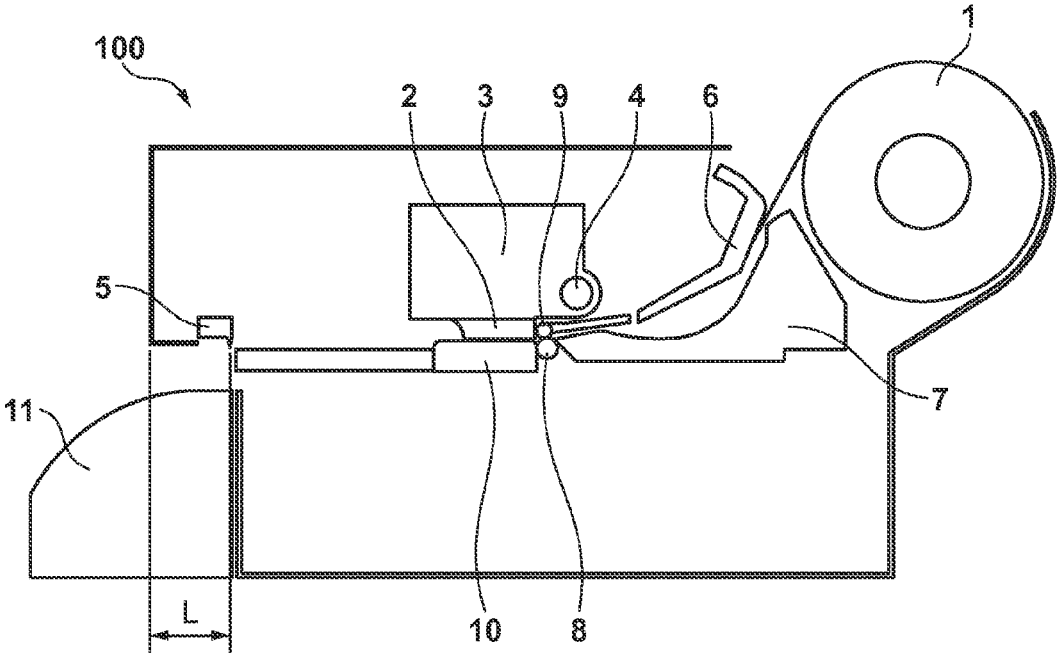
FIG. 1 is a side sectional view showing the schematic arrangement of an inkjet printing apparatus according to an exemplary embodiment of the present invention.

FIG. 1 is a side sectional view showing the schematic arrangement of an inkjet printing apparatus (to be referred to as a printing apparatus hereinafter) according to one embodiment of the present invention, which prints using an inkjet printhead (to be referred to as a printhead hereinafter).

As shown in FIG. 1, a rolled print medium, for example, roll paper 1 held on the printing apparatus 100 is fed to the downstream side of the conveyance direction via a conveyance path formed from an upper guide 6 and a lower guide 7. When the leading end of the roll paper 1 reaches the nip portion between a conveyance roller 8 and a pinch roller 9, the roll paper 1 is nipped by the conveyance roller 8 and the pinch roller 9 and conveyed onto a platen 10 facing a printhead 2. The printhead 2 discharges ink to the roll paper 1 conveyed to the image print portion to print an image. The image print portion is formed from the printhead 2, a carriage 3 including the printhead 2, and the platen 10 facing the printhead 2. The carriage 3 is slidably supported along a carriage shaft 4 and a guide rail (not shown), which are arranged in parallel to each other in the printing apparatus 100, and reciprocally moved.

When an image is printed in the image print portion by one-band scanning of forward or backward movement of the carriage 3, the roll paper 1 is fed by the conveyance roller 8 and the pinch roller 9 in the conveyance direction by a predetermined pitch. The carriage 3 is moved again to perform image print of the next band. The printed portion of the roll paper 1 is conveyed to a discharge guide 11. This processing is repeated to print an image all over a page. When image print ends, the roll paper 1 is conveyed to a predetermined cutting position and cut by a cutter 5 that is a cutting unit. The cut roll paper 1 is discharged from the discharge guide 11 to the outside of the printing apparatus 100. The cutter 5 is arranged on the downstream side of the conveyance direction of the roll paper 1. In this embodiment, the cutter 5 can cut the downstream side of the roll paper 1 during execution of print by the printhead 2 for the roll paper 1.

Let L be the distance from the cutter 5 to the outer periphery of the printing apparatus 100. If the roll paper 1 to be cut is much shorter than the distance L, the paper readily remains at the position after cutting. It is difficult for the user to externally remove the residual. In addition, if the cut paper is very short and has a so-called stripe-like shape, the paper is easily moved by an external factor such as a cutting operation or next print operation and an unexpected malfunction may occur. Hence, the distance L is set as a minimum cut length Lc. The minimum cut length Lc is generally 100 to 200 mm. However, the minimum cut length is not limited to this depending on the arrangement of the printing apparatus.

An example will be described here in which a roll sheet is used as a print medium (or print sheet) to perform print processing. The roll sheet is an example of a continuous sheet. The sheet is not limited to a rolled sheet as long as it is a long continuous sheet capable of printing of a plurality of pages on the same surface without cutting halfway. The continuous sheet can be cut automatically by the printing apparatus or by a manual instruction of the user.

The print method is not limited to image print by an inkjet method using liquid ink for image print (to be described later). Solid ink may be used as a printing material to be added to a print medium. Various methods such as an electrophotographic method using toner, a sublimation method, a thermal transfer method, and a dot impact method can be employed. The printing apparatus is not limited to an apparatus for performing color print using a plurality of color printing materials, and monochrome print using only a black (including gray) printing material may be performed. In FIG. 1, the printing apparatus serves as the control apparatus. However, in a case where the operation of print processing of the printing apparatus is controlled based on an instruction from an external apparatus connected to the printing apparatus shown in FIG. 1, the external apparatus serves as the control apparatus.

Several embodiments of roll paper conveyance control of a printing apparatus having the above-described arrangement will be described next.

<First Embodiment>

Figure 2:
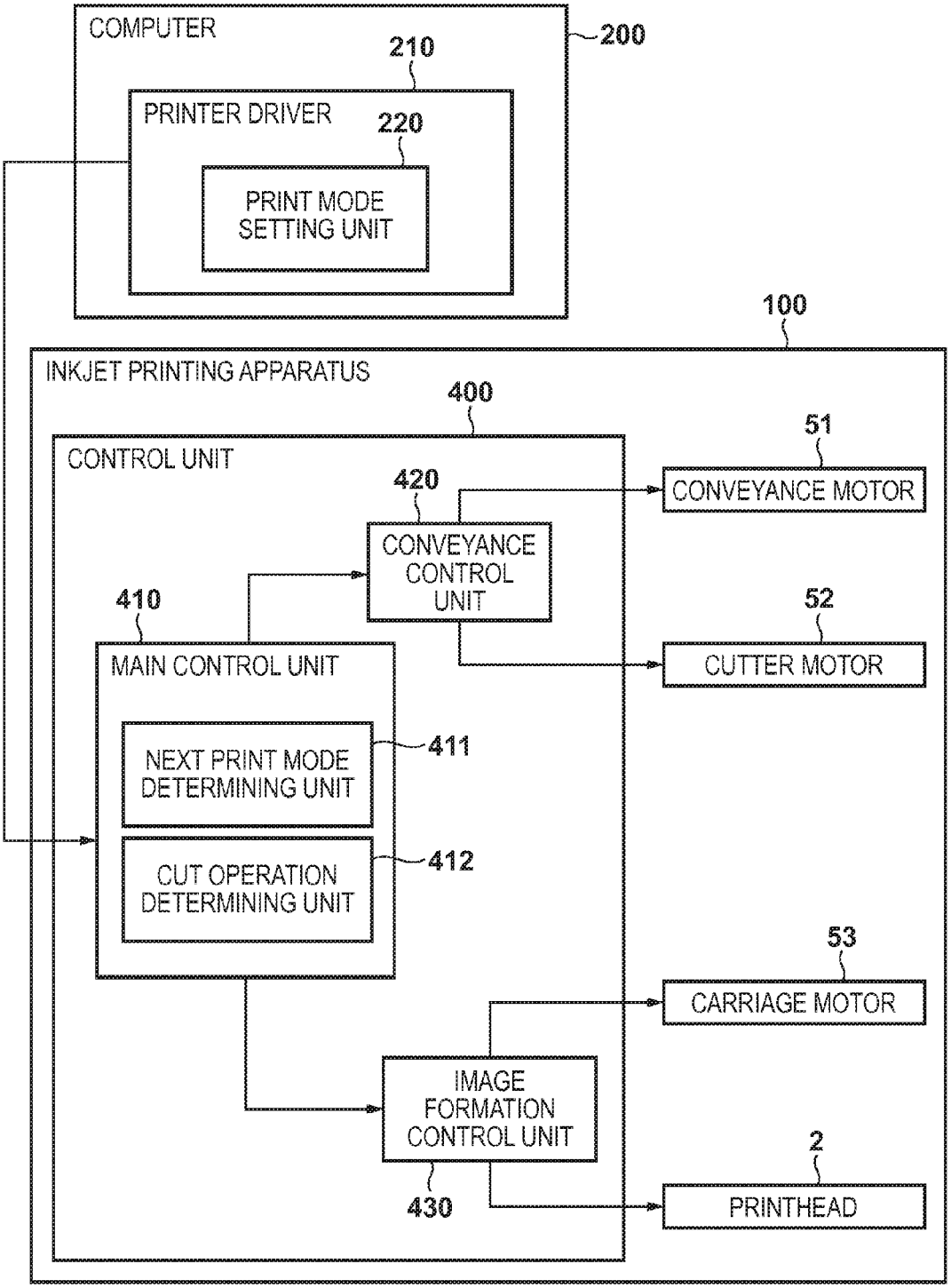
FIG. 2 is a block diagram for explaining the control configuration of a printing apparatus according to the first embodiment.

FIG. 2 is a block diagram showing the schematic control configuration of a printing apparatus according to the first embodiment.

As shown in FIG. 2, a printer driver 210 is installed in a computer 200. The printer driver 210 includes a print mode setting unit 220. The print mode setting unit 220 is used to cause the user to select one of bordered print, marginless one-cut print (first print mode), and marginless two-cut print (second print mode).

On the other hand, a printing apparatus 100 includes a control unit 400, a conveyance motor 51, a cutter motor 52, a carriage motor 53, and a printhead 2.

The control unit 400 includes a main control unit 410, a conveyance control unit 420, and an image formation control unit 430. The conveyance control unit 420 controls the operations of the conveyance motor 51 and the cutter motor 52. The image formation control unit 430 controls the operations of the carriage motor 53 and the printhead 2. That is, the conveyance control unit 420 performs conveyance control and cutting control, and the image formation control unit 430 performs print control.

The control unit 400 also includes a CPU, a ROM, a RAM, a motor driver, and the like (not shown). The CPU controls the operation of the entire printing apparatus 100 by executing a program or activating hardware. The ROM stores programs to be executed by the CPU and permanent data necessary for various operations of the printing apparatus 100. The RAM is used as the work area of the CPU or the temporary storage area of various kinds of received data, or stores various kinds of setting data.

The main control unit 410 includes a next print mode determining unit 411 an a cut operation determining unit 412, and gives instructions to the conveyance control unit 420 and the image formation control unit 430 in accordance with the print mode received from the printer driver 210.

The next print mode determining unit 411 determines the print mode of the next image before the operation of cutting roll paper in marginless one-cut print, that is, before the operation of cutting roll paper after image print. The cut operation determining unit 412 does the next switching in accordance with the determination result of the next print mode determining unit 411. That is, the cut operation determining unit 412 switches the execution timing of the operation of cutting the tail end of the roll paper with a printed image by marginless one-cut print between before the start of print of the next image and after the start of print of the next image. Based on the determination of the main control unit 410, the conveyance control unit 420 drives the conveyance motor 51 to convey roll paper 1 and drives the cutter motor 52 to cut the roll paper 1. The image formation control unit 430 forms an image at an appropriate position by cooperation of the carriage motor 53 and the printhead 2.

Note that the apparatus capable of installing the printer driver is not limited to the computer. For example, a digital camera, a portable telephone, a tablet terminal, or the like is usable in place of the computer if the apparatus includes a wired or wireless interface to the printing apparatus 100 and can transmit an image. Hence, an apparatus including an appropriate interface and capable of transmitting image data to the printing apparatus as a print job will be referred to as a host apparatus.

Image print control in marginless two-cut print and marginless one-cut print of the printing apparatus 100 will be described next.

Figure 3:
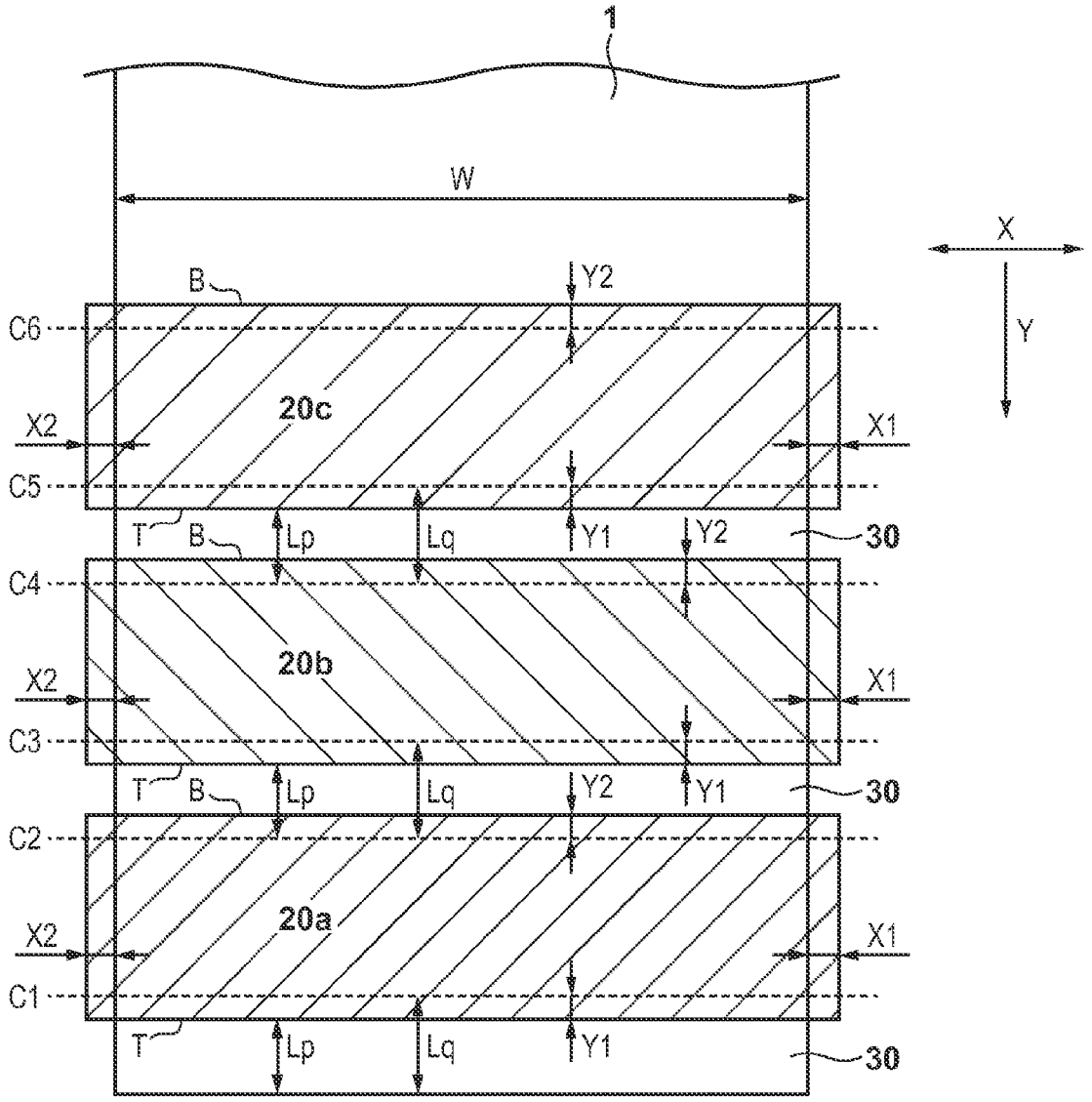
FIG. 3 is a view showing a state in which three print products are printed by marginless two-cut print.
Figure 4:
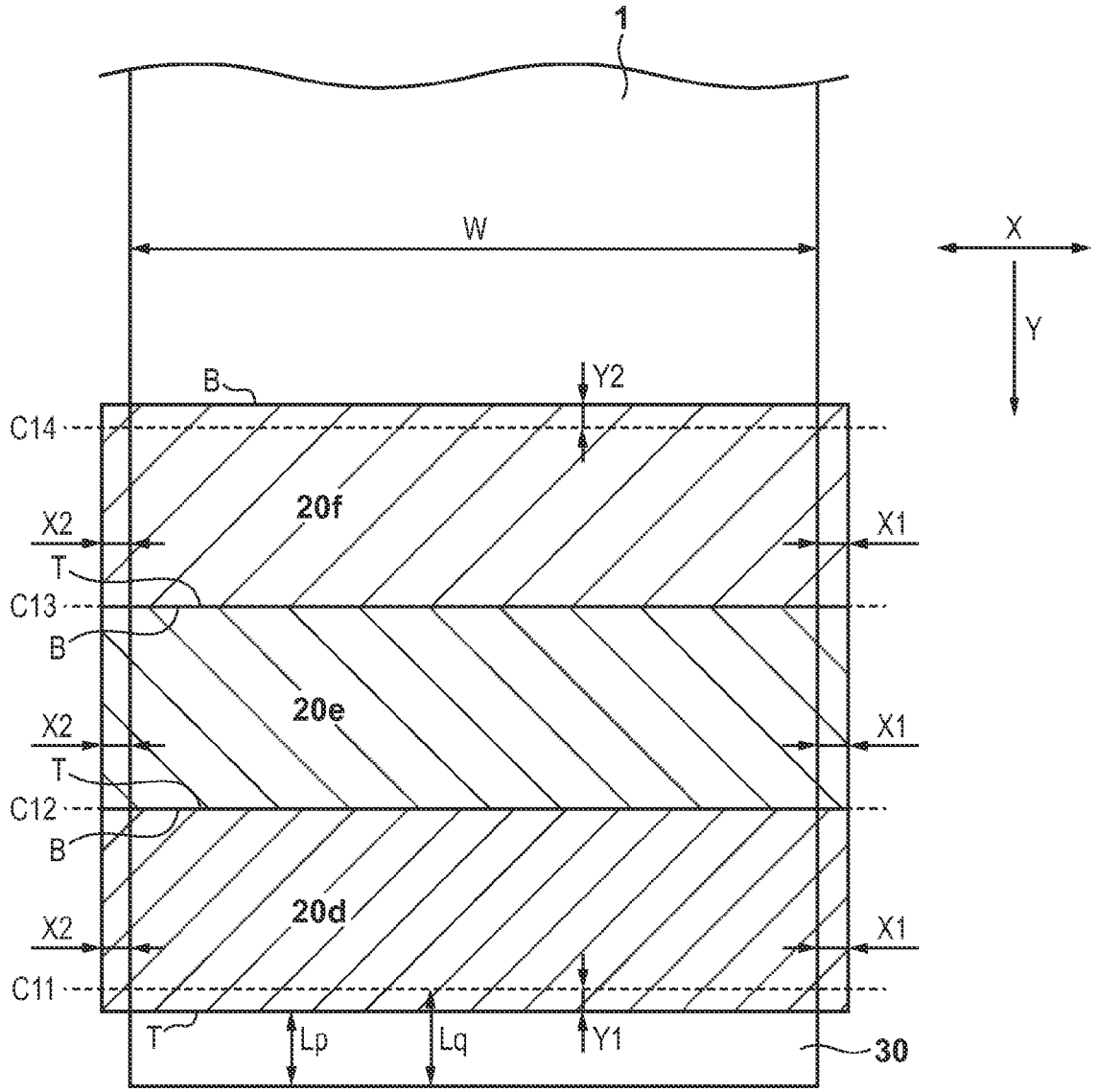
FIG. 4 is a view showing a state in which three print products are printed by marginless one-cut print.
Figure 5:
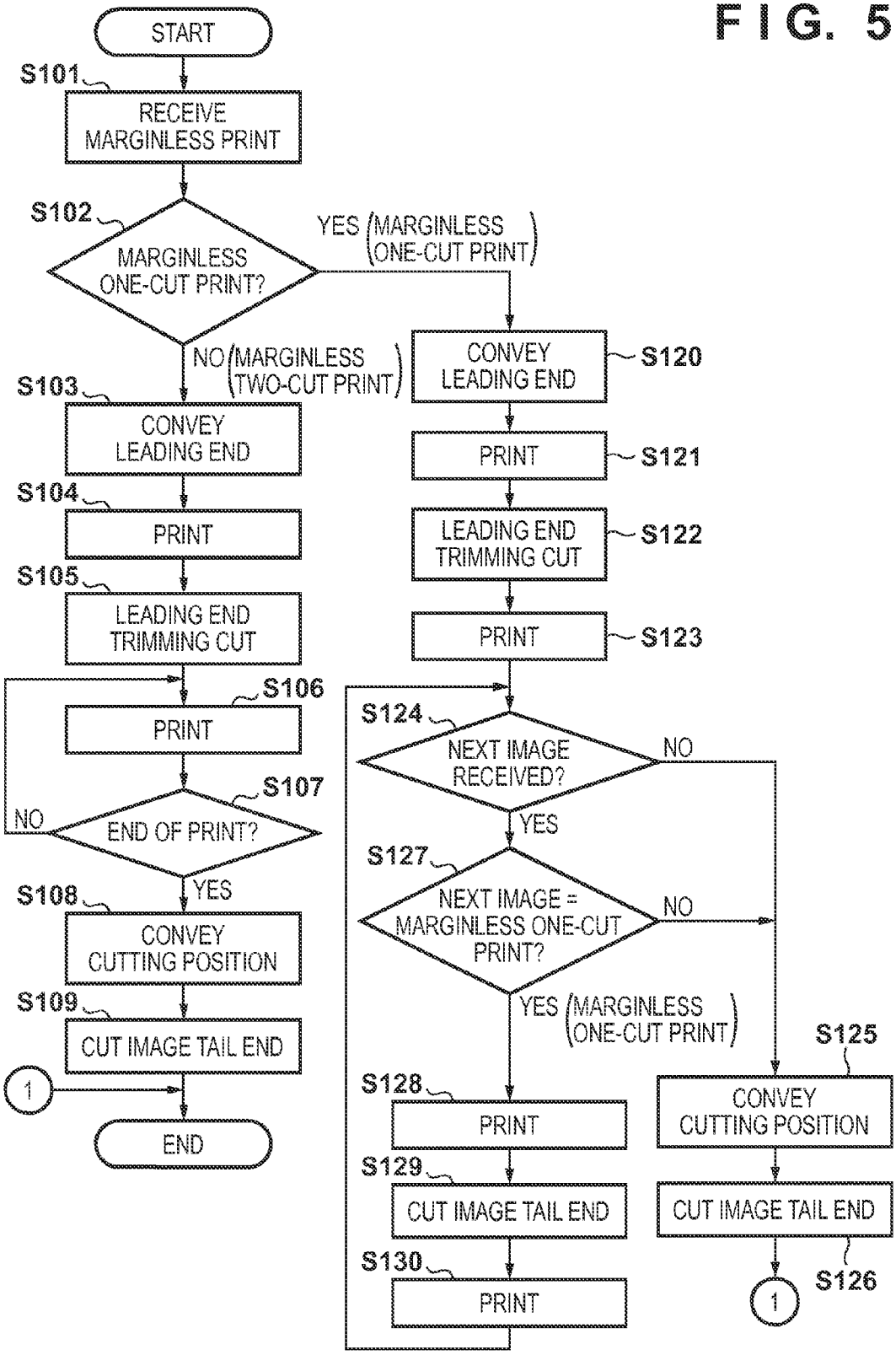
FIG. 5 is a flowchart showing roll paper conveyance control processing according to the first embodiment.

FIG. 3 is a view showing a state in which three print products are printed by marginless two-cut print. FIG. 4 is a view showing a state in which three print products are printed by marginless one-cut print. Note that each broken line shown in FIGS. 3 and 4 indicates a position where the roll paper 1 is cut by the cutter 5. FIG. 5 is a flowchart showing roll paper conveyance control processing according to the first embodiment.

A print control method in marginless two-cut print will be described first with reference to FIG. 3. Referring to FIG. 3, an arrow X represents the moving direction (main scanning direction) of the printhead 2, and an arrow Y represents the conveyance direction (sub-scanning direction) of the roll paper 1. The downstream side in the conveyance direction of the roll paper 1 is defined as an image leading end T, and the upstream side as an image tail end B. A print instruction unit transmitted from the printer driver 210 is defined as a job. Different jobs indicate print instructions transmitted from different printer drivers 210 or print instructions transmitted from the same printer driver 210 at different timings.

When the printing apparatus 100 receives a job of marginless two-cut print, the roll paper 1 is conveyed in the Y direction such that the length from the leading end of the roll paper 1 to the image leading end T of an image 20*a* becomes a leading end fed length Lp. The printhead 2 discharges ink, and print of the image 20*a* starts. As the print of the image 20*a* progresses, a cutting position C1 reaches the attachment position of the cutter 5, and the roll paper 1 is cut at the position. At this time, on the leading end side of the image 20*a*, cutting is done at a position moved from the image leading end T into the image 20*a* by a step-in length Y1. Hence, a marginless image without a margin at the leading end can be formed.

Note that the operation of cutting at the cutting position C1 is defined as leading end trimming cut. A leading end trimming cut length Lq of a leading end fed portion 30 to be cut off by leading end trimming cut is controlled so as to meet $Lq=(Lp+Y1)\geq Lc$. The leading end trimming cut length Lq is restricted by a minimum cut length Lc described above. This is because if all lengths cut off from the roll paper 1 by the cutter 5 are less than the minimum cut length Lc, a discharge error or malfunction may occur. Note that the step-in length Y1 is, for example, about 3 mm.

In print in the main scanning direction, the printhead 2 discharges ink up to a position moved rightward from the right end of the roll paper 1 by an amount indicated by an extra-printing width X1, and up to a position moved leftward from the left end of the roll paper 1 by an amount indicated by an extra-printing width X2. That is, ink is discharged within a range exceeding a width W of the roll paper 1 in the main scanning direction to form a marginless image without a margin concerning the right and left ends of the roll paper 1. Note that the extra-printing widths X1 and X2 are, for example, about 3 mm. The ink discharge within the range exceeding the width W of the roll paper 1 is possible if a platen 10 of the printing apparatus 100 has a structure capable of accepting ink. When the print of the image 20*a* progresses and ends, the roll paper is conveyed in the Y direction until a cutting position C2 of the roll paper 1 reaches the attachment position of the cutter 5.

The cutting position C2 is a position indicated by a step-in length Y2 on the downstream side of the image tail end B of the image 20*a*. When the cutting position C2 of the roll paper reaches the attachment position of the cutter 5, the roll paper 1 is cut at the position. The operation of cutting off the image 20*a* is defined as an image tail end cutting operation. At this time, on the tail end side of the image 20*a*, cutting is done at a position moved from the image tail end B into the image 20*a* by the step-in length Y2. Hence, a marginless image without a margin at the tail end can be formed. Note that the step-in length Y2 is, for example, about 3 mm.

Next, upon continuously receiving a job of marginless two-cut print, the cutting position C2 is defined as the leading end of the roll paper 1, and print of an image 20*b* is started by conveying the roll paper 1 in the Y direction such that the length to the image leading end T of the image 20*b* becomes the leading end fed length Lp. As for the subsequent operation, the leading end of the image 20*b* is cut at a cutting position C3, as in the print of the image 20*a*. After that, when the print of the image 20*b* ends, the tail end of the image 20*b* is cut at a cutting position C4. A print product without a margin at the leading end and tail end of the image 20*b* can thus be formed. Upon further continuously receiving a job of marginless two-cut print, the leading end and tail end of an image 20*c* are cut at cutting positions C5 and C6, respectively, as in the print of the image 20*b*, thereby forming a marginless print product. With the above-described operation, a marginless print product without a margin on all of the four sides can be formed.

Note that with the above-described operation, in marginless two-cut print, the leading end fed portion 30 corresponding to the leading end trimming cut length Lq that occurs at the time of leading end trimming cut is created as waste paper for each print product. However, by cutting at positions moved inside by the step-in lengths Y1 and Y2, it is possible to absorb a cutting position shift caused by the attachment position shift of the cutter 5 or a conveyance accuracy error and an error of the cutting accuracy in the width direction of the roll paper 1. This can prevent adjacent images from stepping in and maintain the high quality of the print product. Hence, the marginless two-cut print is used for, for example, a quality-oriented print product. The numerical values of Y1, Y2, X1, and X2 are merely examples and are not limited to these depending on the arrangement of the printing apparatus.

A print control method in marginless one-cut print will be described next with reference to FIG. 4. An image 20*d*, an image 20*e*, and an image 20*f* are, for example, images of different print jobs.

When the printing apparatus 100 receives a job of marginless one-cut print, the roll paper 1 is conveyed in the Y direction such that the length from the leading end of the roll paper 1 to the image leading end T of the image 20*d* becomes the leading end fed length Lp. The printhead 2 discharges ink, and print of the image 20*d* starts. As the print of the image 20*d* progresses, a cutting position C11 of the roll paper 1 reaches the attachment position of the cutter 5, and the roll paper 1 is cut at the position. At this time, the image 20*d* is cut at a position moved from the image leading end T into the image 20*d* by the step-in length Y1. Hence, a marginless image without a margin at the leading end is formed. Note that the leading end trimming cut for cutting at the cutting position C11 is the same as that in marginless two-cut print. The leading end fed portion 30 corresponding to the leading end trimming cut length Lq is created.

In print in the main scanning direction, ink is discharged up to a position moved rightward from the right end of the roll paper 1 by an amount indicated by the extra-printing width X1, and up to a position moved leftward from the left end of the roll paper 1 by an amount indicated by the extra-printing width X2, as in marginless two-cut print.

In addition, during print of the image 20*d*, more specifically, during the period from the start of print of the image 20*d* to the completion of print, the next print mode determination unit 411 determines the print mode of the next image. If the print mode of the next image is marginless one-cut print, print of the image 20*e* starts from a position approximately matching the image tail end B of the image 20*d* without executing the cutting operation of the image tail end of the image 20*d* by the cutter 5. The image tail end B of the image 20*d* thus approximately matches the image leading end T of the image 20*e*, and this position is a cutting position C12.

As the print of the image 20*e* progresses, the cutting position C12 of the roll paper 1 reaches the attachment position of the cutter 5, and the roll paper 1 is cut at the position. Along with the cutting operation, the image 20*d* is cut off from the roll paper 1, and a print product without a margin at the leading end and tail end of the image 20*d* can be formed. As described above, in the marginless one-cut print, cutting is done at the cutting position C12 between the image 20*d* and the image 20*e* in the cutting operation of the image tail end, thereby cutting off the image 20*d*. Note that cutting is performed only once because the image tail end B of the image 20*d* and the leading end T of the image 20*e* approximately match each other, as described above. In the cutting operation of the image tail end of the image 20*d*, a marginless image without a margin even for the leading end of the image 20*e* can be formed.

In addition, during print of the image 20*e*, more specifically, during the period from the start of print of the image 20*e* to the completion of print, the next print mode determining unit 411 determines the print mode of the next image again. If the print mode of the next image is marginless one-cut print, print of the image 20*f* starts from a position approximately matching the image tail end B of the image 20*e*. In this case as well, the image tail end B of the image 20*e* approximately matches the image leading end T of the image 20*f*, and this position is a cutting position C13 of the roll paper 1. As the print of the image 20*f* progresses, and the cutting position C13 of the roll paper 1 reaches the attachment position of the cutter 5, the roll paper 1 is cut at the cutting position C13. A print product without a margin at the tail end of the image 20*e* can thus be formed by the cutting operation of the image tail end, and a marginless image without a margin even for the leading end of the image 20*f* can be formed.

After that, if the next print mode determination unit 411 determines, during the print of the image 20*f*, that the print mode of the next image is not the marginless one-cut print, it is determined to add a margin and print the next image. Note that if the next image does not exist, the roll paper 1 is conveyed in the Y direction without performing the next print until a cutting position C14 of the roll paper 1 reaches the attachment position of the cutter 5. The cutting position C14 is a position indicated by the step-in length Y2 on the downstream side of the image tail end B. In both a case where the print mode of the next image is not marginless one-cut print and a case where the next image does not exist, when the cutting position C14 reaches the attachment position of the cutter 5, the roll paper 1 is cut at the position. At this time, the image 20*f* is cut at a position moved from the image tail end B into the image 20*f* by the step-in length Y2. Hence, a marginless image without a margin at the tail end is formed.

With the above-described operation, a marginless print product without a margin on all of the four sides can be formed.

The leading end trimming cut of marginless one-cut print is an operation necessary in a case where the first image is printed after attachment of the roll paper 1, in a case where the print mode of the preceding print product is bordered print or marginless two-cut print, or in a case where the print mode of the preceding print product is marginless one-cut print in which the cutting operation of the image tail end was executed. In this embodiment, with the above-described operation, even if marginless one-cut print is continuously performed for different print jobs, images are continuously printed without forming a margin between the images of marginless one-cut print. Hence, in the marginless one-cut print, since the leading end fed portion 30 by leading end trimming cut is not formed between the images of marginless one-cut print, waste paper by the leading end fed portion 30 can be reduced. However, since the boundary between the continuously printed images is cut, adjacent images may step in between the images of marginless one-cut print because of a cutting position shift caused by the attachment position shift of the cutter 5 or a conveyance accuracy error, or an error of the cutting accuracy in the width direction of the roll paper. Hence, the marginless one-cut print is used for a purpose of reducing waste paper as much as possible.

Note that in this embodiment, the print mode is determined during the period from the start of print of a certain image to the tail end cutting operation of the image. However, the timing is not limited to this if the next image can continuously be printed without forming a margin at the tail end of the image that is going to end the print. For example, the print mode may be determined during print of an image previous to the image.

If the position (print position) of the printhead and the position (cutting position) of the cutter 5 are spaced apart, the cutter 5 cuts the roll paper after image print has completely ended.

A series of operations according to the first embodiment from reception of a job as a print instruction to formation of a print product will be described next with reference to FIG. 5. FIG. 5 is a flowchart executed by the main control unit 410.

In step S101, the printing apparatus 100 receives a job of marginless print set by the printer driver 210. In step S102, it is determined whether the received job is a job of marginless one-cut print. More specifically, the setting of the corresponding print mode is checked, and it is determined whether the print is marginless one-cut print or marginless two-cut print.

In a case where it is determined in step S102 that the print mode is marginless two-cut print (NO in step S102), the process advances to step S103. To form a print product in accordance with marginless two-cut print, the roll paper 1 is fed by the leading end fed length Lp for leading end trimming cut. In step S104, print is started from a predetermined position. In step S105, if the cutting position of the leading end trimming cut of the roll paper reaches the attachment position of the cutter 5 during print, the print is temporarily interrupted, and leading end trimming cut is executed. A marginless image without a margin at the image leading end is thus formed.

Even after the leading end trimming cut, the print is continued in step S106. In step S107, it is determined whether the image print based on the received data has ended. Note that if the received data includes marginless two-cut print of a plurality of copies or a plurality of pages, print is executed while forming a margin between images. In a case where it is determined that the print has ended, the process advances to step S108 to feed the cutting position of the image tail end of the roll paper 1 after the print to the attachment position of the cutter 5. In step S109, the roll paper 1 is cut while partially leaving the image on the roll paper 1, thereby forming a marginless image without a margin at the image tail end. A print product of marginless print is thus formed, and the series of print operations ends.

On the other hand, in a case where it is determined that the print mode is marginless one-cut print (YES in step S102), the process advances to step S120. To form a print product in accordance with marginless one-cut print, the roll paper 1 is fed by the leading end fed length Lp for leading end trimming cut. In step S121, print is started from a predetermined position. In step S122, if the cutting position of the leading end trimming cut of the roll paper reaches the attachment position of the cutter 5 during print, the print is temporarily interrupted, and leading end trimming cut is executed. A marginless image without a margin at the image leading end is thus formed.

Even after the leading end trimming cut, the print is continued in step S123. Note that if the received data includes marginless one-cut print of a plurality of copies or a plurality of pages, print is executed without forming a margin between images. In step S124, the next print mode determined unit 411 confirms whether the next image data is received. That is, the next print mode determined unit 411 determines whether the next print job is received.

If the next image data is not received, the process advances to step S125. After the image print, the cutting position of the image tail end of the roll paper 1 is fed to the attachment position of the cutter 5. In step S126, the roll paper 1 is cut while partially leaving the image on the roll paper 1, thereby forming a marginless image without a margin at the image tail end. A print product of marginless print is thus formed, and the series of print operations ends. Note that here, after the print, the roll paper is fed in step S108 and cut in step S109. However, if the received data includes marginless one-cut print of a plurality of copies or a plurality of pages, the cutting position of the tail end of a previously printed image may reach the attachment position of the cutter 5 during print of a certain image in the received data. In this case, when the cutting position that is the boundary between the image tail end B of the preceding image and the image leading end T of the image under print reaches the attachment position of the cutter 5, the print is temporarily interrupted, and the image tail end cutting operation is executed at the position.

On the other hand, in a case where it is determined in step S124 that the next image data is received, the process advances to step S127, and the next print mode determined unit 411 confirms whether the print mode of the next image is marginless one-cut print or a mode other than marginless one-cut print. If the print mode of the next image of the received data is a mode other than marginless one-cut print, the process advances to step S125, as in the case where the next image data is not received, to execute the above-described processing. On the other hand, if the print mode of the next image is marginless one-cut print, the process advances to step S128.

In step S128, print of the next image starts from a position approximately matching the image tail end B of the printed image. In step S129, when the cutting position that is the boundary between the image tail end B of the preceding image and the image leading end T of the image under print reaches the attachment position of the cutter 5, the print is temporarily interrupted. The image tail end cutting operation is executed at the position. The preceding image is thus cut off from the roll paper 1, and a print product of marginless print is formed. For the image under print, a marginless image without a margin at the image leading end is formed.

After the cutting operation of the image tail end, print is continued in step S130. Then, the process returns to step S124, and the next print mode determined unit 411 confirms again whether the next image is received. In this way, the above-described operation is repetitively executed.

In the above-described embodiment, an example in which received data is data of marginless one-cut print or marginless two-cut print has been explained. However, if received data includes both data of marginless one-cut print and that of marginless two-cut print, it is determined in step S102 whether the print mode of data to be printed last out of the received data is marginless one-cut print. If the print mode of data to be printed last out of the received data is marginless one-cut print, the process advances to step S120. If the print mode of data to be printed last out of the received data is marginless two-cut print, the process of step S102 is repeated.

Note that in the flowchart of FIG. 5, a job of marginless two-cut print is received. If the next job is received after the end of print of the job, the flowchart of FIG. 5 is executed again. In this case, step S101 may start before the process advances to steps S108 and S109.

Figure 6:
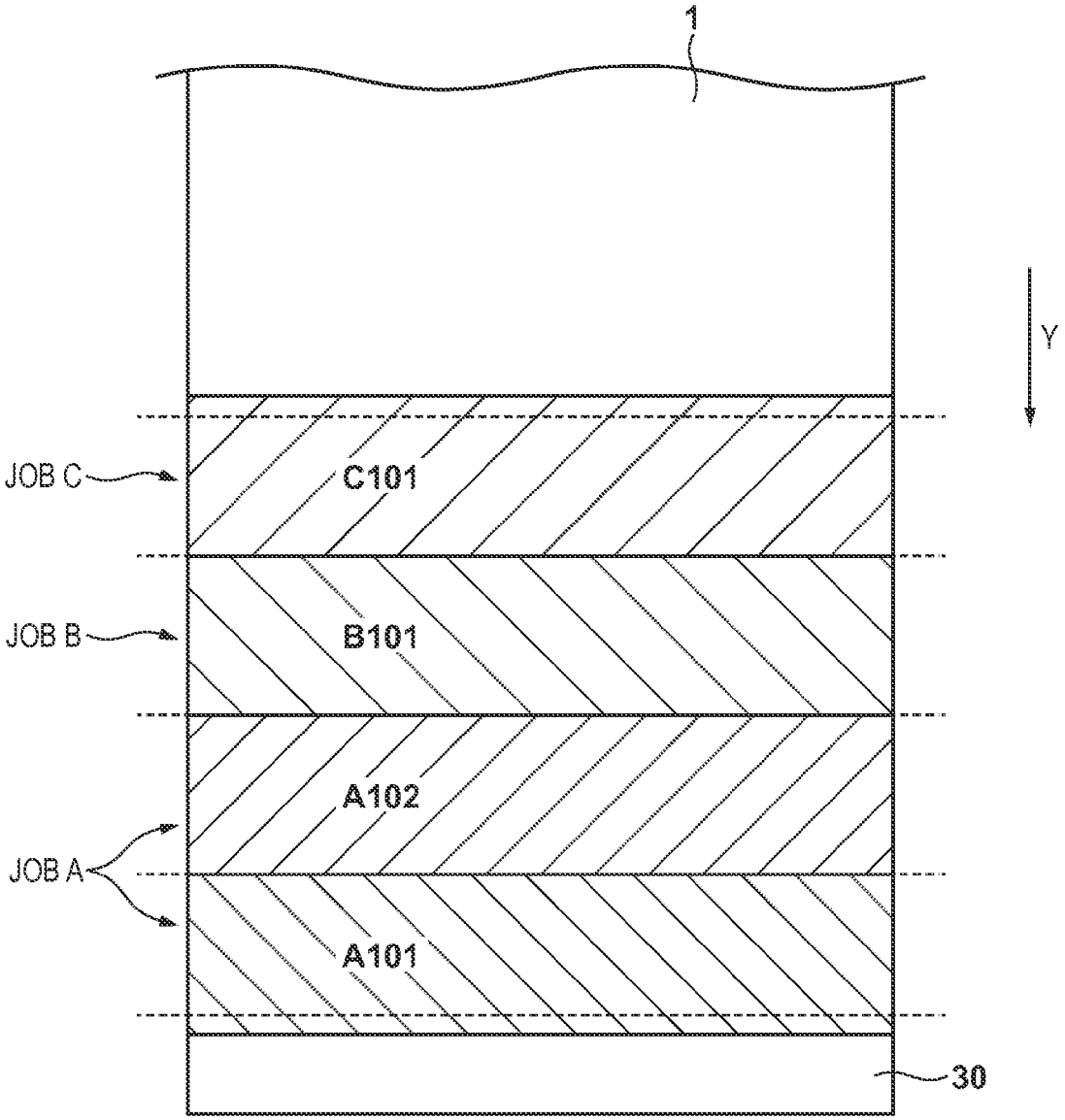
FIG. 6 is a view showing a state in which images are printed by specifying marginless one-cut print in different jobs by the printing apparatus according to the first embodiment.

FIG. 6 is a view showing a state in which images are printed by specifying marginless one-cut print in different jobs by the printing apparatus according to the first embodiment.

The difference of the print state of marginless one-cut print between the conventional printing apparatus and the printing apparatus according to this embodiment will be described with reference to FIGS. 6 and 11.

Figure 11:
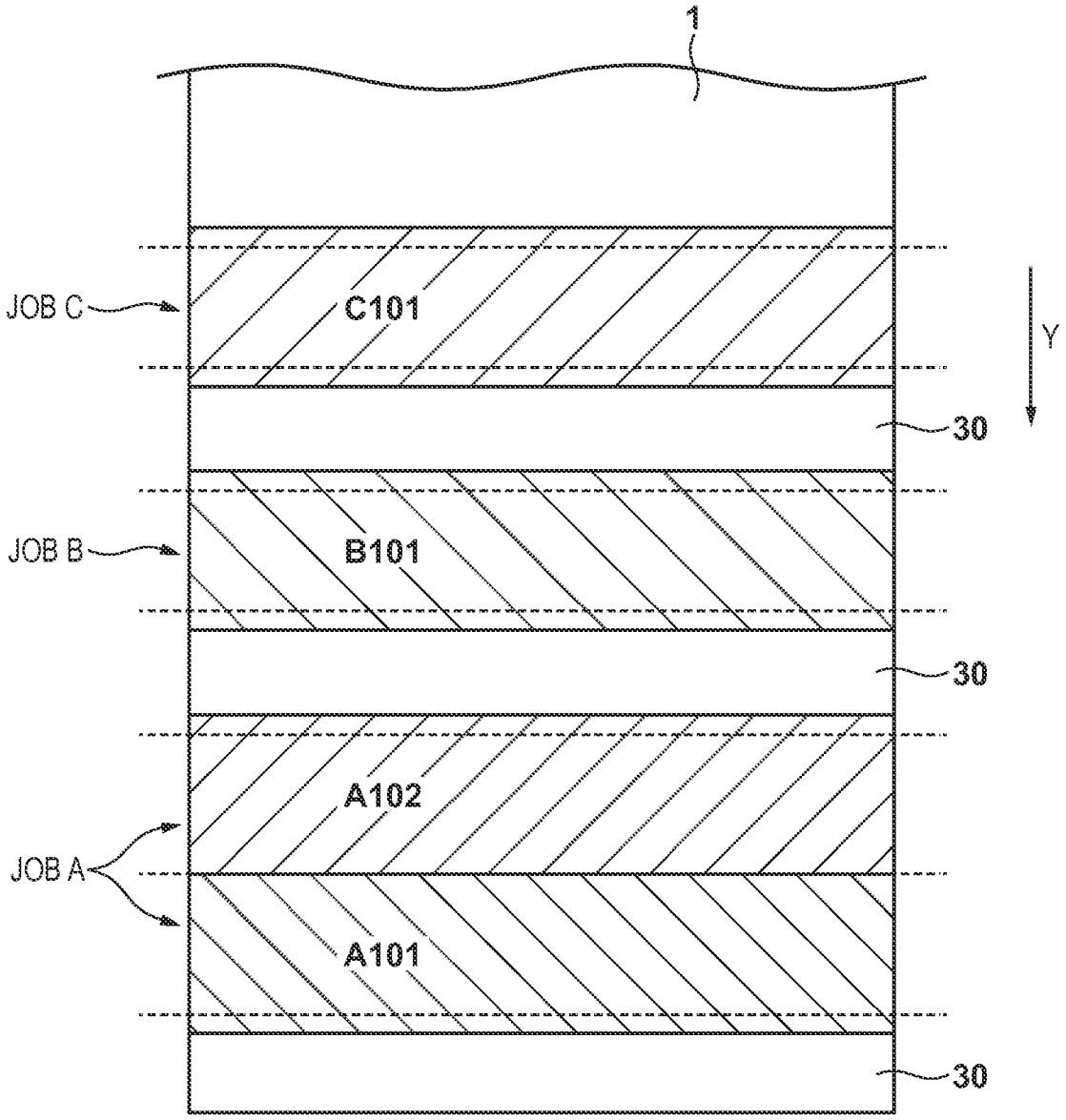
FIG. 11 is a view showing a state in which images are printed by specifying marginless one-cut print in different jobs by a conventional printing apparatus.

Note that both FIGS. 6 and 11 illustrate an image print state in a case where different job A, job B, and job C of marginless one-cut print are continuously received. The job A, job B, and job C print two images, one image, and one image, respectively. Each broken line shown in FIGS. 6 and 11 indicates a position where the roll paper is cut by the cutter 5.

In this embodiment, upon printing an image by marginless one-cut print, if the print mode of the next image is marginless one-cut print, print is performed without adding a margin between the image and the next image, as shown in FIG. 6. For this reason, the leading end fed portion 30 as waste paper, which is created in the conventional printing apparatus, as shown in FIG. 11, need not be provided between the jobs, that is, between the second image of the job A and the image of the job B and between the image of the job B and the image of the job C. Note that the above-described number of jobs and the numbers of images in the jobs are merely examples and are not limited to these.

Hence, according to the above-described embodiment, in a case where marginless one-cut print is used, the print mode of the next print is determined before the print of each job ends. If the print mode of the next job is marginless one-cut print, it is determined to continuously print the leading end of the next image following the tail end of the image, and print is performed. Then, the boundary between the image tail end and the image leading end of the next image is cut off, and a print product of marginless one-cut print is output. In this way, the cutting operation of the image tail end is not executed after the print of the job. In addition, the image of the next job is continuously printed following the image tail end of one job, that is, without providing a margin. More specifically, it is determined in accordance with the set print mode whether to add a margin between images to be continuously printed by different jobs, and the print medium is conveyed in accordance with the determination result. Hence, if jobs of marginless one-cut print continue not only in the same job but also between different jobs, print can be performed without adding a margin between the continuously printed images. This can reduce waste paper caused by a margin added between images.

In this embodiment, the next print mode determined unit 411 determines the print mode of the next job during print of an image. This makes it possible to execute print without stopping conveyance of the print medium and improve the throughput.

<Second Embodiment>

Here, control, particularly, a series of operations from reception of a job as a print instruction to formation of a print product in a case where a next print mode determined unit 411 determines that the job of the next print product is not received will be described. Note that the same reference numerals as in the first embodiment denote the same constituent elements or process steps, and a description thereof will be omitted.

Figure 7:
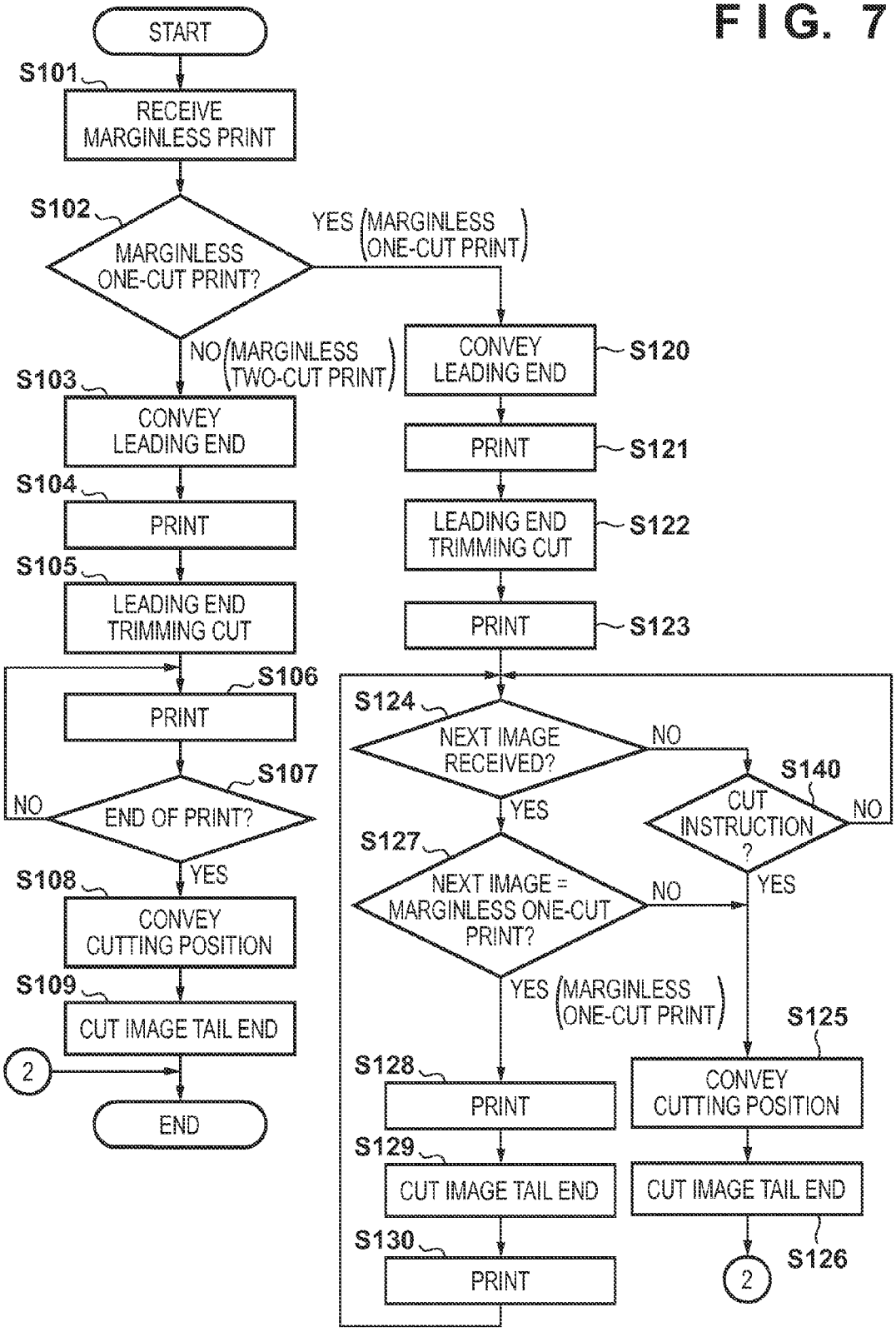
FIG. 7 is a flowchart showing roll paper conveyance control processing according to the second embodiment.
Figure 8:
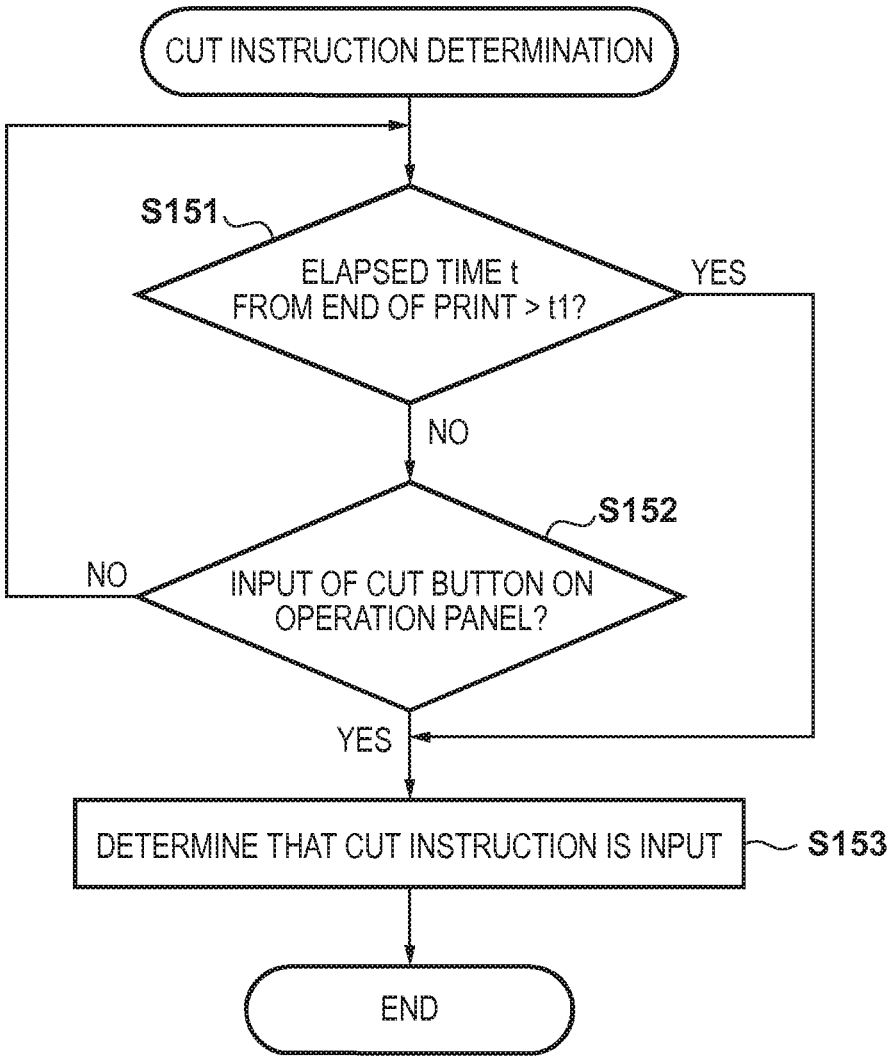
FIG. 8 is a flowchart showing processing of determining a cut instruction.

FIG. 7 is a flowchart showing the series of operations according to the second embodiment from reception of a job as a print instruction to formation of a print product. FIG. 8 is a flowchart showing processing of determining a cut instruction according to the second embodiment. FIG. 7 is a flowchart executed by a main control unit 410.

In steps S101 and S102, a job of marginless print is received, and if the print mode is marginless two-cut print, the processes of steps S103 to S109 are executed, as described in the first embodiment.

On the other hand, if the print mode is marginless one-cut print, the same processes as in the first embodiment are executed in steps S120 to S124. If the print of the image based on the received data ends, the next print mode determined unit 411 confirms in step S124 whether the next image data is received. In other words, the next print mode determined unit 411 confirms whether the next print job is received.

If the next image data is received, the processes of steps S127 to S130 are executed, as in the first embodiment. If the next image data is not received, the process advances to step S140 to confirm whether a cut instruction is input. If no cut instruction is input, the process returns to step S124 to confirm reception of the next image data again. In this way, the processing waits without executing the cutting operation of the image tail end until a cut instruction is input. At this time, conveyance of the print medium stops.

Cut instruction determination processing will be described here with reference to FIG. 8.

In step S151, it is checked whether an elapsed time t from the end of print of the preceding image exceeds a standby time t1 registered in advance or the standby time t1 settable on an operation panel or the like. If $t>t1$, the process advances to step S153 to determine that a cut instruction is input. If $t\leq t1$, the process advances to step S152.

In step S152, it is checked whether a button (for example, cut button) on the operation panel to prompt the cutting operation is input. If such button input is done, the process advances to step S153 to determine that a cut instruction is input. If a button on the operation panel to prompt the cutting operation is not input, the process returns to step S151. Even if the elapsed time t from the end of print of the preceding image is equal to or less than t1, if a button (for example, cut button) on the operation panel to prompt the cutting operation is input, it is determined that a cut instruction is input. In addition, if a predetermined time has elapsed, it is determined that a cut instruction is input.

Referring back to FIG. 7, if it is determined in step S140 that a cut instruction is input, or if it is confirmed in step S127 that the data of a print product in a print mode other than marginless one-cut print is received, the processes of steps S125 and S126 are executed. The series of print operations thus ends.

Note that if the next image data is received in a state in which no cut instruction is input, and the print mode of the image is marginless one-cut print, the subsequent processing is the same as the operation in a case where jobs of marginless one-cut print continue in the first embodiment. That is, to continuously print images as marginless one-cut print, the printing apparatus starts without adding a margin between images.

Hence, according to the above-described embodiment, even in a case where an image is printed by marginless one-cut print, and the job of the next image is not received at the end of the print, the cutting operation of the image tail end can wait. Hence, if a job of marginless one-cut print is received after that, the preceding image and the next image can continuously be printed without adding a margin between them. This can reduce waste paper caused by a margin added between images, which are generated between jobs.

In addition, if a predetermined time or more elapses in a state in which the cutting operation of the image tail end in marginless one-cut print waits, the cutting operation of the image tail end can be executed. This can reduce an unexpected malfunction caused when, for example, a job is left stand for a long time, and the image print region of the print product deforms. Furthermore, if a button on the operation panel that prompts the cutting operation is input in a state in which the cutting operation of the image tail end in marginless one-cut print waits, the cutting operation of the image tail end can be executed. For this reason, even in a state in which a printed image is not cut off yet when the user comes to pick up the print product, a print product of marginless print can be acquired by executing the cutting operation of the image tail end as needed.

Note that in this embodiment, both the elapsed time from the end of print and the input of the cut button on the operation panel are used to determine the cut instruction. However, only one of them may be used to determine the cut instruction.

<Third Embodiment>

Here, control, particularly, a series of operations from reception of a job as a print instruction to formation of a print product upon continuously printing images in different jobs using marginless one-cut print will be described. Note that the same reference numerals as in the first and second embodiments denote the same constituent elements or process steps, and a description thereof will be omitted.

Figure 9:
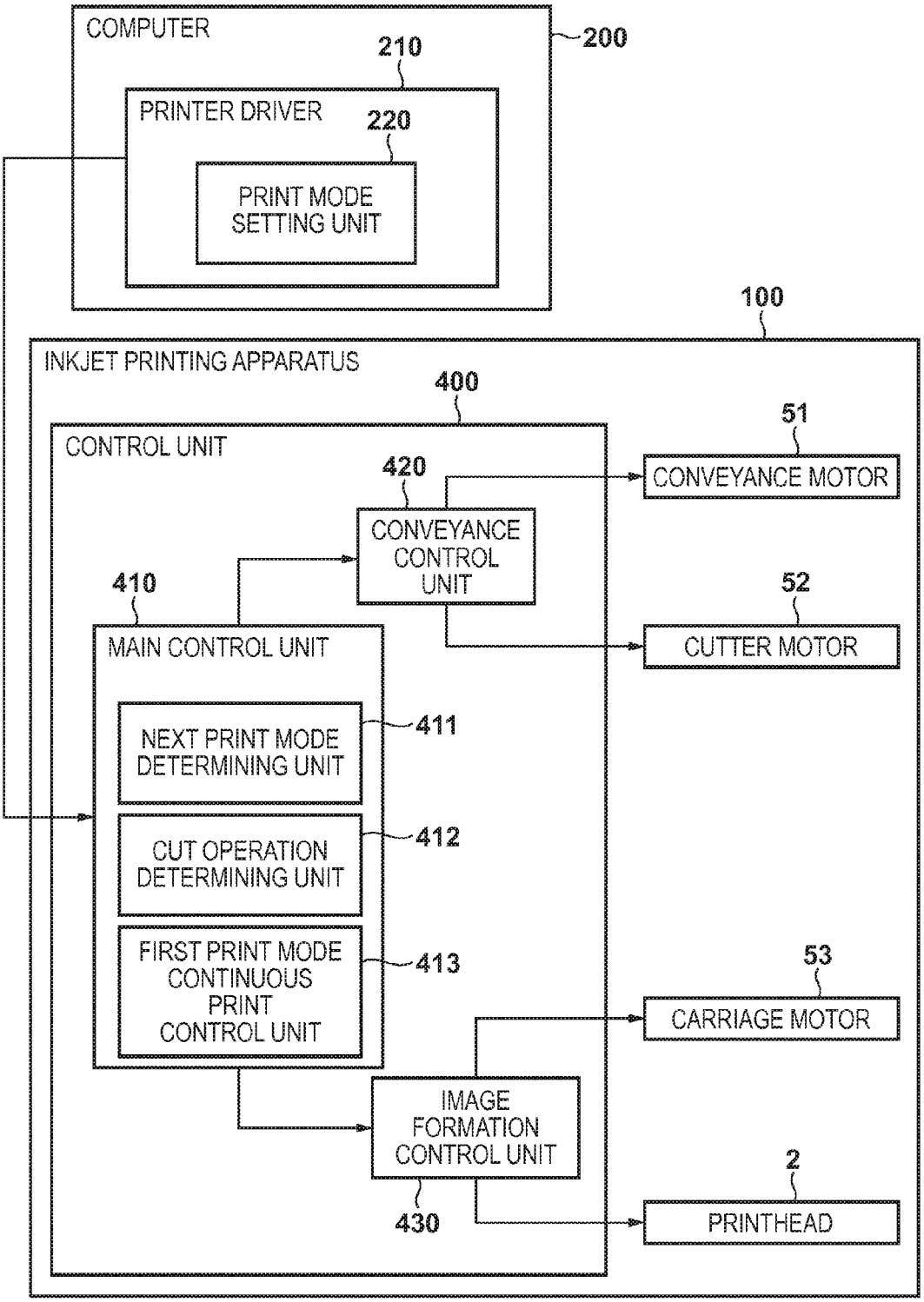
FIG. 9 is a block diagram for explaining the control configuration of a printing apparatus according to the third embodiment.

FIG. 9 is a block diagram showing the control configuration of a printing apparatus according to the third embodiment.

In this embodiment, a main control unit 410 includes a first print mode continuous print control unit 413, as compared to the arrangement according to the first embodiment shown in FIG. 2. The rest of the arrangement is the same as in the first embodiment.

Figure 10:
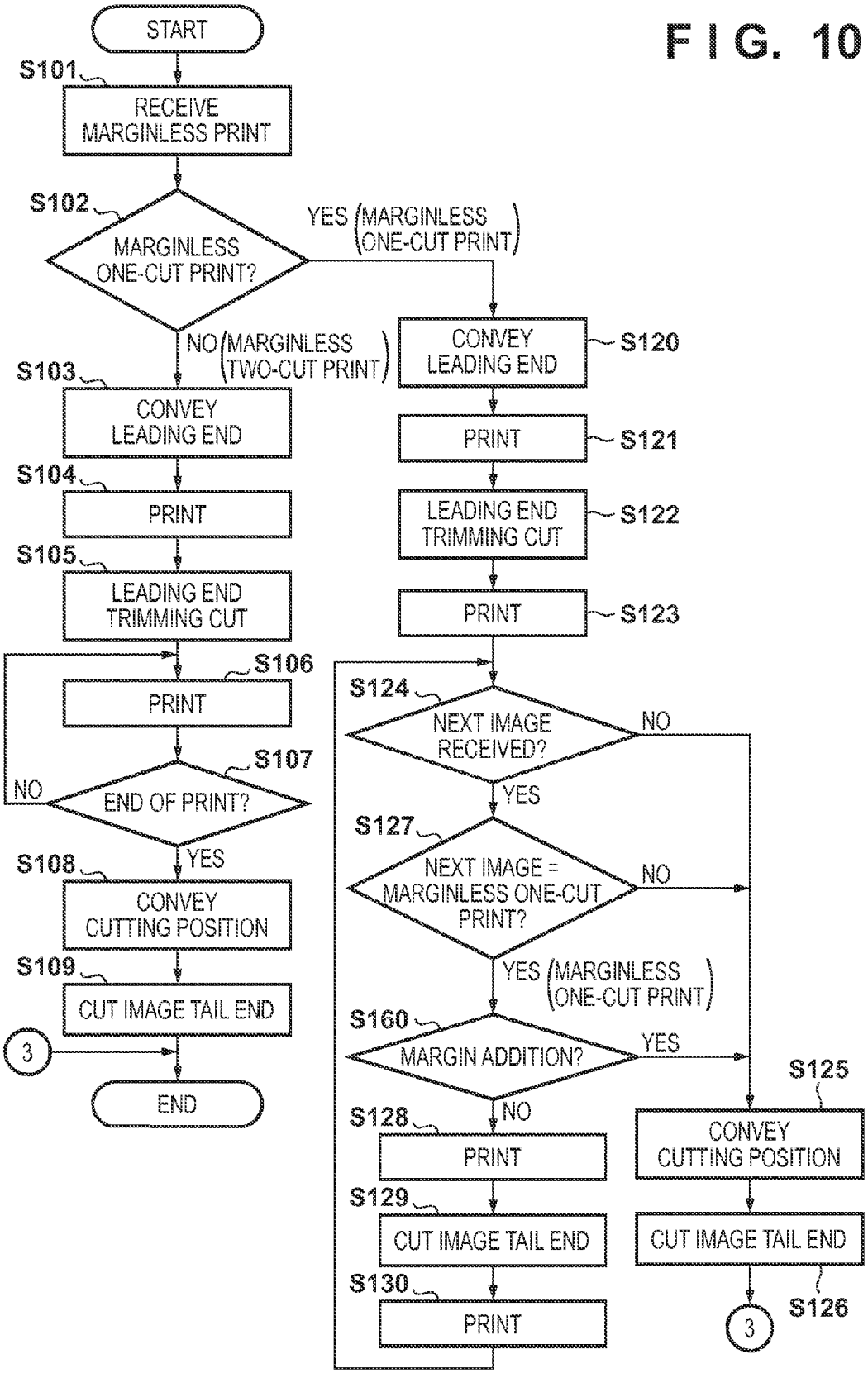
FIG. 10 is a flowchart showing roll paper conveyance control processing according to the third embodiment.

FIG. 10 is a flowchart showing roll paper conveyance control processing according to the third embodiment.

In steps S101 and S102, a job of marginless print is received, and if the print mode is marginless two-cut print, the processes of steps S103 to S109 are executed, as described in the first embodiment.

On the other hand, if the print mode is marginless one-cut print, the same processes as in the first embodiment are executed in steps S120 to S124. If the print of the image based on the received data ends, the next print mode determined unit 411 confirms in step S124 whether the next image data is received. If the next image data is not received, the processing is the same as in the first embodiment. The processes of steps S125 and S126 are executed, and the series of processes ends. On the other hand, if the next image data is received, the process advances to step S127.

In step S127, the next print mode determined unit 411 confirms whether the print mode of the next image is marginless one-cut print or a mode other than marginless one-cut print. If the print mode of the next image is a mode other than marginless one-cut print, the processing is the same as in the first embodiment. The processes of steps S125 and S126 are executed, and the series of processes ends. On the other hand, if the print mode of the next image is marginless one-cut print, the process advances to step S160.

In step S160, it is determined whether to continuously start printing the next image as marginless one-cut print. This determination is executed by the first print mode continuous print control unit 413 included in the main control unit 410 shown in FIG. 9. Based on information in a printer driver 210 or information set in a printing apparatus 100 from the operation panel, the first print mode continuous print control unit 413 determines whether to continuously start print as marginless one-cut print between different jobs. For example, if no margin setting instruction is input from the operation panel, it is determined to continuously start print as marginless one-cut print even between different jobs. If a margin setting instruction is input from the operation panel, it is determined not to continuously start print, and a margin is added.

In a case where it is determined to continuously start print as marginless one-cut print even between different jobs, the process advances to step S128 to control conveyance of roll paper so as to start print without adding a margin between the images of different jobs. As for subsequent processing, the processes of steps S128 to S130 are executed as described in the first embodiment. On the other hand, in a case where it is determined not to continuously start print as marginless one-cut print between different jobs, the process advances to step S125 to execute the same processing as described in the first embodiment.

Hence, according to the above-described embodiment, it can be determined based on a user instruction whether to continuously start print as marginless one-cut print between different jobs. It is therefore possible to set, in accordance with the application purpose of the user, whether to continuously start print without adding a margin between the images of different jobs or add a margin between the images and start print. For this reason, the user can easily switch between margin addition and suppression of margin addition even though a case where step-in of an adjacent image is acceptable between different jobs and a case where step-in of an adjacent image is not acceptable between different jobs occur.

In the above-described embodiment, the next print mode determining unit 411 determines the print mode of the next job during print of an image. However, the present invention is not limited to this, and the determination may be done after print of an image. In this case, conveyance of the print medium is stopped after the print of the image.

Note that in the above-described embodiments, an inkjet printing apparatus using a serial-type printhead has been exemplified. However, the present invention is also applicable to a serial-type printing apparatus using another print method and a printing apparatus using a full-line printhead.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-095500, filed May 2, 2014, which is hereby incorporated by reference herein in its entirety.

What is claimed is:

1. A control apparatus comprising:

a print control unit configured to cause a printing unit to print an image on a print medium based on a job; and a determination unit configured to determine, in accordance with a mode of a first job and a mode of a second job next to the first job, whether to add a margin between an image to be printed based on the first job and an image to be printed based on the second job.

2. The apparatus according to claim 1, wherein the mode includes:

marginless one-cut print of performing marginless print by printing without adding a margin between images to be continuously printed in a conveyance direction of a continuous sheet and causing a cutter to cut a boundary between the continuously printed images; and marginless two-cut print of performing marginless print by printing while adding a margin between the images to be continuously printed in the conveyance direction of a continuous sheet and causing the cutter to cut an upstream side and a downstream side of the printed images in the conveyance direction so as to cut off the margin.

3. The apparatus according to claim 1, wherein if the mode of the first job and the mode of the second job are continuously marginless one-cut print, said determination unit determines not to add a margin between the image to be printed based on the first job and the image to be printed based on the second job.

4. The apparatus according to claim 1, further comprising a second determination unit configured to determine whether a cut instruction for instructing to cut a continuous sheet is received, wherein in a case where said second determination unit determines that the cut instruction is received, a conveyance unit is caused to convey the continuous sheet to cause a cutter to cut the continuous sheet.

5. The apparatus according to claim 4, further comprising an instruction unit configured to instruct to cut a continuous sheet, wherein in a case where an elapsed time from an end of print of the image exceeds a predetermined time or in a case where an instruction by said instruction unit is input, said second determination unit determines that the cut instruction is input.

6. The apparatus according to claim 1, further comprising a cut control unit configured to cause a cutter to cut a continuous sheet, wherein the cutter is provided at a predetermined position on a downstream side of the printing unit with respect to a conveyance direction of the continuous sheet, and said cut control unit controls to cause the cutter to cut the continuous sheet in a case where the printed image reaches a cutting position.

7. The apparatus according to claim 1, further comprising the printing unit.

8. The apparatus according to claim 1, wherein the mode is set via a printer driver installed in an external apparatus.

9. A control method comprising:

causing a printing unit to print an image based on an input job; and determining, in accordance with a mode of a first job and a mode of a second job next to the first job, whether to provide a margin between an image printed based on the first job and an image to be printed based on the second job.

10. A non-transitory computer readable storage medium which stores a computer program to be executed in a control apparatus, the program comprising:

causing a printing unit to print an image based on an input job; and determining, in accordance with a mode of a second job next to a first job, whether to provide a margin between an image printed based on the first job and an image to be printed based on the second job.

* * * * *